US005699687A

United States Patent [19]

Pittman

[11] Patent Number: 5,699,687

[45] Date of Patent: Dec. 23, 1997

[54] FIREARM SECURITY DEVICE

[76] Inventor: John M. Pittman, 2540 Dillard Rd., Bowling Green, Ky. 42104

[21] Appl. No.: 659,291

[22] Filed: Jun. 6, 1996

[51] Int. Cl.[6] ..... F41A 17/02

[52] U.S. Cl. ..... 70/376; 42/70.11; 70/57; 70/58; 70/14; 70/1.5

[58] Field of Search ..... 70/DIG. 77, DIG. 29, 70/DIG. 78, DIG. 79, 379 R, 379 A, 375, 34, 369, 57, 58, 14, 1.5; 42/70.11

[56] References Cited

U.S. PATENT DOCUMENTS

| | | | |
|---|---|---|---|
| 1,866,342 | 7/1932 | Best | 70/369 |
| 2,327,334 | 8/1943 | Parker | 42/70.11 |
| 2,530,560 | 11/1950 | Young | 42/70.11 |
| 3,368,297 | 2/1968 | Lentz | 42/70.07 |
| 3,768,189 | 10/1973 | Goodrich | 42/70.11 |
| 3,820,283 | 6/1974 | Acerra et al. | 70/34 |
| 3,831,521 | 8/1974 | Engeli | 172/2 |
| 4,185,480 | 1/1980 | Pechner | 70/358 |
| 4,252,006 | 2/1981 | Swisher | 70/34 |
| 4,398,366 | 8/1983 | Wernicki | 42/70.11 |
| 4,512,099 | 4/1985 | Mathew | 42/70.11 |
| 4,614,097 | 9/1986 | Signorelli | 70/34 |
| 4,908,971 | 3/1990 | Chaney | 42/70.11 |
| 5,054,223 | 10/1991 | Lee | 42/70.11 |
| 5,115,589 | 5/1992 | Shuker | 42/70.11 |
| 5,138,785 | 8/1992 | Paterson | 42/70.11 |
| 5,239,767 | 8/1993 | Briley, Jr. et al. | 42/70.11 |
| 5,289,653 | 3/1994 | Szebeni et al. | 42/70.11 |
| 5,450,685 | 9/1995 | Peterson | 42/70.11 |
| 5,475,994 | 12/1995 | Brilgy, Jr. et al. | 42/70.11 |

FOREIGN PATENT DOCUMENTS

| | | | |
|---|---|---|---|
| 2561369 | 9/1985 | France | 42/70.11 |
| 1526304 | 9/1978 | United Kingdom | 70/34 |
| 2220253 | 1/1990 | United Kingdom | 42/70.11 |
| 2234047 | 1/1991 | United Kingdom | 42/70.11 |
| 8600396 | 1/1986 | WIPO | 42/70.11 |
| 8806264 | 8/1988 | WIPO | 42/70.11 |

*Primary Examiner*—Darnell M. Boucher
*Attorney, Agent, or Firm*—Chris A. Caseiro; Thomas L. Bohan

[57] ABSTRACT

A firearm-securing device providing tamper resistance features which device includes a keyway that operates a threaded rod which, in turn, controls spring-loaded cams that obstruct a tubular area including a chamber, a barrel, and a muzzle of a firearm. The cams have either fixed or articulated contact pads. Operating the keyway in clockwise rotation causes the cams to wedge against the inner chamber and barrel surfaces, locking the device in place. Counterclockwise keyway rotation unseats the cams, allowing the device to be remove from the chamber and barrel and thus allow operation of the firearm. The device includes several components designed to minimize tampering of the device itself as well as tampering of the firearm.

28 Claims, 3 Drawing Sheets

FIREARM SECURITY DEVICE

BACKGROUND OF THE INVENTION

1. Field of the Invention

This invention relates to tubular locking devices. More particularly, this invention relates to an apparatus designed for use within muzzle, barrel, forcing cone, and chamber sections of a handgun, shotgun, or rifle of all bore sizes and which prevents operation of the firearm while the apparatus is engaged.

2. Background of the Invention

Generally, firearms are composed of a stock or hand piece, a hammer, a trigger, a firing pin, a chamber, and a barrel. During operation, a round of ammunition is placed within the chamber. Activation of the trigger causes the hammer to strike the firing pin which strikes the round, which discharges a projectile. The projectile travels from the chamber through the barrel and exits through a muzzle at the end of the barrel in a manner well known throughout the firearm art. The barrel commonly has rifling on an inner surface of the barrel to focus projectile movement.

Firearms are inherently dangerous devices. Accordingly, safety devices are a well known and important feature throughout the firearm art; however, few of these devices are common in the marketplace. Such prior-art devices typically operate either by preventing the trigger from activation or by placing cabling through the breech and barrel-methods that fail to prevent tampering of the devices themselves. An alternative manner by which firearm safety devices operate is by blocking a portion or all of the firearm's muzzle, barrel, and chamber. The device of Lee (U.S. Pat. No. 5,054,223) shows a basic prior-art design of blocking a portion of a gun barrel at the muzzle end. The device of Stewart (U.S. Pat. No. 3,154,874) shows a basic prior-art design of blocking a portion of a gun barrel at the chamber end. The devices of Garretson (U.S. Pat. No. 2,479,107) and Matthew (U.S. Pat. No. 4,512,099) both show a prior design of blocking the barrel from the chamber to the muzzle, inclusive. A lock is provided in some designs for extra security.

Many prior-art firearm safety devices are engaged and disengaged within the barrel by a screw-type action. The screw-type action causes expandable parts to press against the inner bore of the firearm. This lodges the safety device in the barrel and inhibits firearm operation. In Lee's device, where only a portion of the barrel nearer the muzzle is obstructed, the firearm would not be rendered completely inoperable. The placement of a round into the chamber and activation of the trigger would not be affected by the presence of Lee's device in the muzzle end of the barrel. Firing such a weapon with its barrel blocked is extremely hazardous.

Attempted prior-art improvements provided an extension of the safety device into the chamber of the firearm. The device of Matthew shows such a safety design. The device operates through a screw-type action to wedge a cam against the inner surface of the firearm's chamber. Similarly, the device of Garretson shows a locking pin which expands against the chamber's inner surface. The limited surface contact within the chamber may allow these designs to become loosened and subject to failure when a force is placed upon the exposed muzzle end of the devices.

Prior-art firearm safety devices which expand within a barrel, chamber, or muzzle commonly are designed in a configuration which may damage the rifling within precision-tooled barrels. An example of this is found in the device of Lee, as well as the device of Shuker (U.S. Pat. No. 5,115,589). The pointed cams of such a device expanding within the barrel or chamber can cause significant damage to rifling on the barrel's inner surface during routine activation and deactivation. This may impair firearm operation by altering the trajectory of the projectile and adversely affect the value of the firearm. All of the devices described in these references exhibit varying degrees of vulnerability to tampering.

Further, prior-art firearm safety devices have failed to provide adequate self-protection against attempts to defeat them. A deficiency common to known designs is a failure to adequately protect against such tampering attempts, as by use of a drill, a hacksaw, a grinder, a torch, a crushing vice, or simply by brute force used to remove the safety device.

Hence, it is necessary to provide a firearm safety device that dependably prevents firearm operation. As well, such a device should be highly tamper-resistant when installed and should not damage the precisely-tooled rifling and inner surfaces of a firearm when routinely used. Further, such a device preferably may cause significant damage to the inner surfaces of the firearm during any attempt to compromise the integrity of the security device. In that way, the usefulness, accuracy, and/or value of the firearm will be significantly reduced, thereby reducing the likelihood that the device will be tampered with.

SUMMARY OF THE INVENTION

Accordingly, it is an object of the present invention to provide a locking device for use within a tubular element. More particularly, it is an object of the present invention to provide a locking device that prevents firearm operation while the device is engaged and that allows firearm operation after the device is disengaged. The locking device according to the present invention resides within an entire length of a firearm barrel including the full length of the chamber of the firearm, particularly during activation of the device. It is a further object of the present invention to provide authorized users of the firearm with an easily engaged and disengaged firearm security device. Another object of the present invention is to provide a locking device of unitary construction with a high level of self-resistance to tampering that is non-damaging to the firearm during normal operation and deployment of the locking device. Yet another object of the present invention is to provide a locking device the length and breadth of which is self-protected internally and externally against various tampering techniques based on the arrangement of components. Still another object of the present invention is to provide a locking device to be used specifically within a firearm bore, and yet is non-damaging to the bore during normal locking device operation and deployment while potentially causing significant damage to the bore and inner surfaces during any significant attempt to compromise the invention's integrity. Such damage resulting in a detraction from the firearm's original utility, accuracy, and value which may act as a deterrent, in and of itself, to unauthorized users.

These objectives are accomplished by providing a locking device which includes a lock, a flared rotating cam shaft, and diametrically opposed and strategically positioned multiple cams with fixed, yet replaceable, contacting pads. Alternatively, the cams may be articulated. Sets consisting of a minimum of two cams are located circumferentially relative to other sets of cams. The cams are engaged and disengaged by the cam shaft via the lock, resulting in pad contact and non-contact, respectively, with inner surfaces of the chamber and barrel. The cam shaft both displaces and houses the cams. The lock is housed within a housing. The foundation of the lock housing is designed to be manufactured to conform to any given muzzle design. The foundation having a cushion that is replaceable and made of a material that is preferably, but not limited to, a hydrophobic, rubber-like, dense, replaceable, and durable material. The cushion providing protection at the union of the lock foundation and muzzle. In a preferred embodiment of the invention, the interface between the lock housing and its foundation are to be manufactured in a single procedure such that they are capable of receiving and shielding the firearm muzzle and the region near the muzzle as uniformly and smoothly as possible.

Another object of the present invention is to provide a locking device which includes encasement of a sufficient hardness to resist mechanical tampering. The housing is typically, though not limited to, a hard non-corrosive metal such as steel, a preferred lock being of the double-sided pin tumbler type. Two types of keys are provided for use in the lock. One key is designed to be removed so as maintain the locking device in either an engaged position or disengaged position. The other key is a safety-key that is designed to stay within the locking device for selectively engaging and disengaging the locking device.

It is an object of the present invention to provide cams with contacting pads of sufficient softness so that damage, as seen in the prior-art, to the rifling within the barrel does not occur. The pads are replaceable and made of a material that is softer than the barrel's material. The instant invention's pads are typically, though not limited to, a soft metal such as brass or aluminum. Another object of the present invention is to provide multiple points of contact along the inner surfaces of the chamber and barrel to provide a firm and secure engagement which prevents unintended loosening of the locking device from the firearm. Still another object of the present invention is to provide a heat-sensitive anti-tampering element that precludes unauthorized disengagement of the locking device upon element activation due to tampering by use of a heat source such as an acetylene torch. In order to prevent, or at least minimize damage to the interior of the firearm, as well as damage to the device itself, the present invention is designed to "self-protect" inner surfaces of the firearm and the device during routine operation. This is achieved through the introduction of a bidirectional slip gear that prevents over-torquing of the device within the firearm. This feature of the present device is also advantageous in that it can be used to create an audible sound when complete engagement or disengagement of the device has been achieved. The user is thereby signalled to cease operation of the device so as to prevent over-torquing.

These objectives, as well as any additional objectives not specifically set forth above, will be apparent to those skilled in the art from the description below with reference to the drawings.

DESCRIPTION OF THE PREFERRED EMBODIMENT

It is to be understood that, while one embodiment of the invention is identified by the figures above, these figures are only considered illustrative of the invention. Circumstances will arise where it is necessary to modify the above embodiment. Such modifications may be made without straying from the scope of the present invention. Although the invention is usable within firearms of most all calibers, gauges, and barrel lengths, the invention may be utilized in any suitable application without departing from the intention or purpose of the invention.

Figures 1, 5:
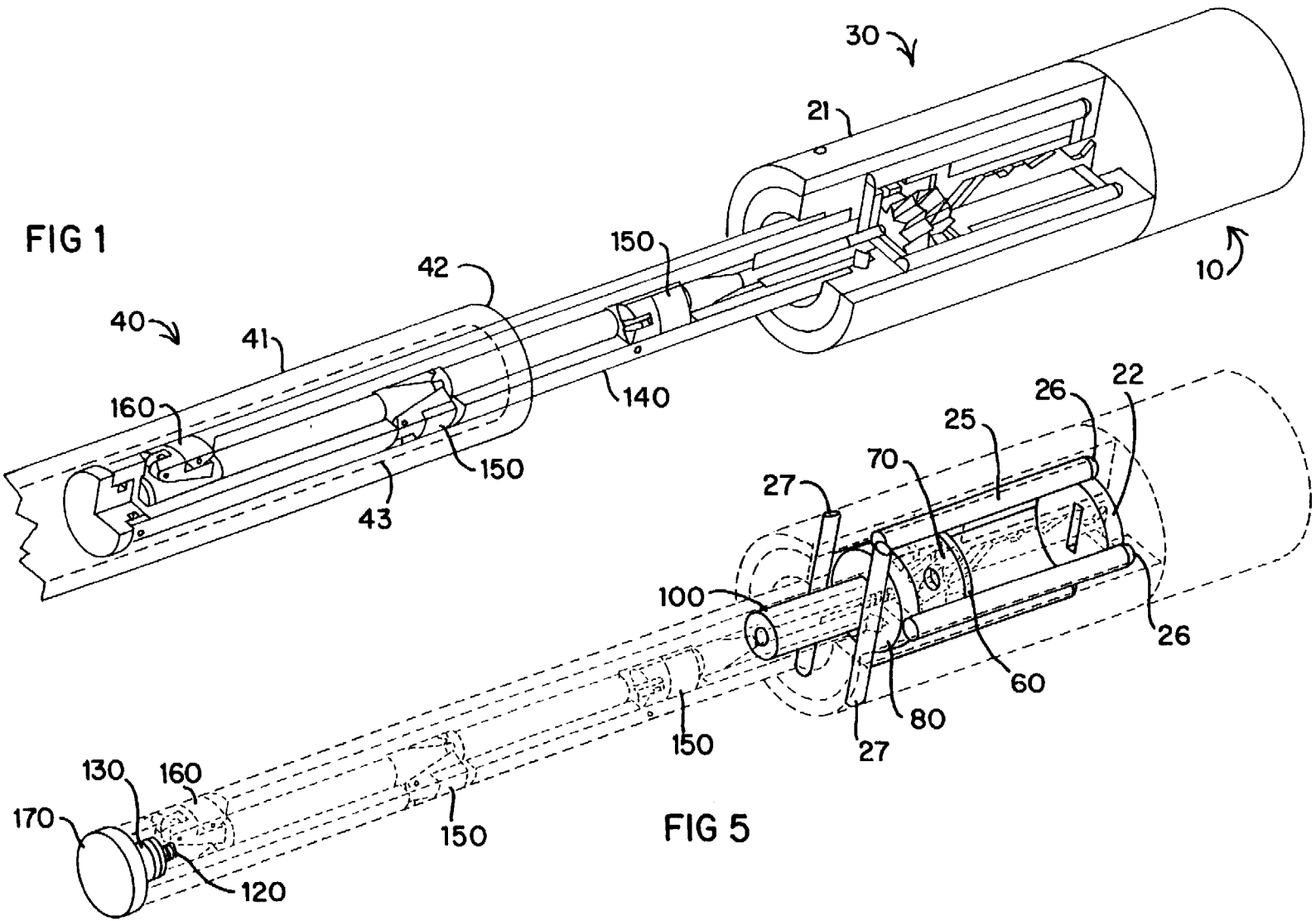
FIG. 1 is a longitudinal sectional view of the locking device in accordance with the present invention shown partially inserted into a known firearm device.
FIG. 5 is a perspective view of the anti-tampering components in accordance with the present invention.

A locking device 30 of the present invention, as generally indicated in FIG. 1, is a type of lock which prevents firearm operation by preventing ammunition from being chambered and by blocking a barrel 41 of a firearm 40.

Figures 2A, 2B:
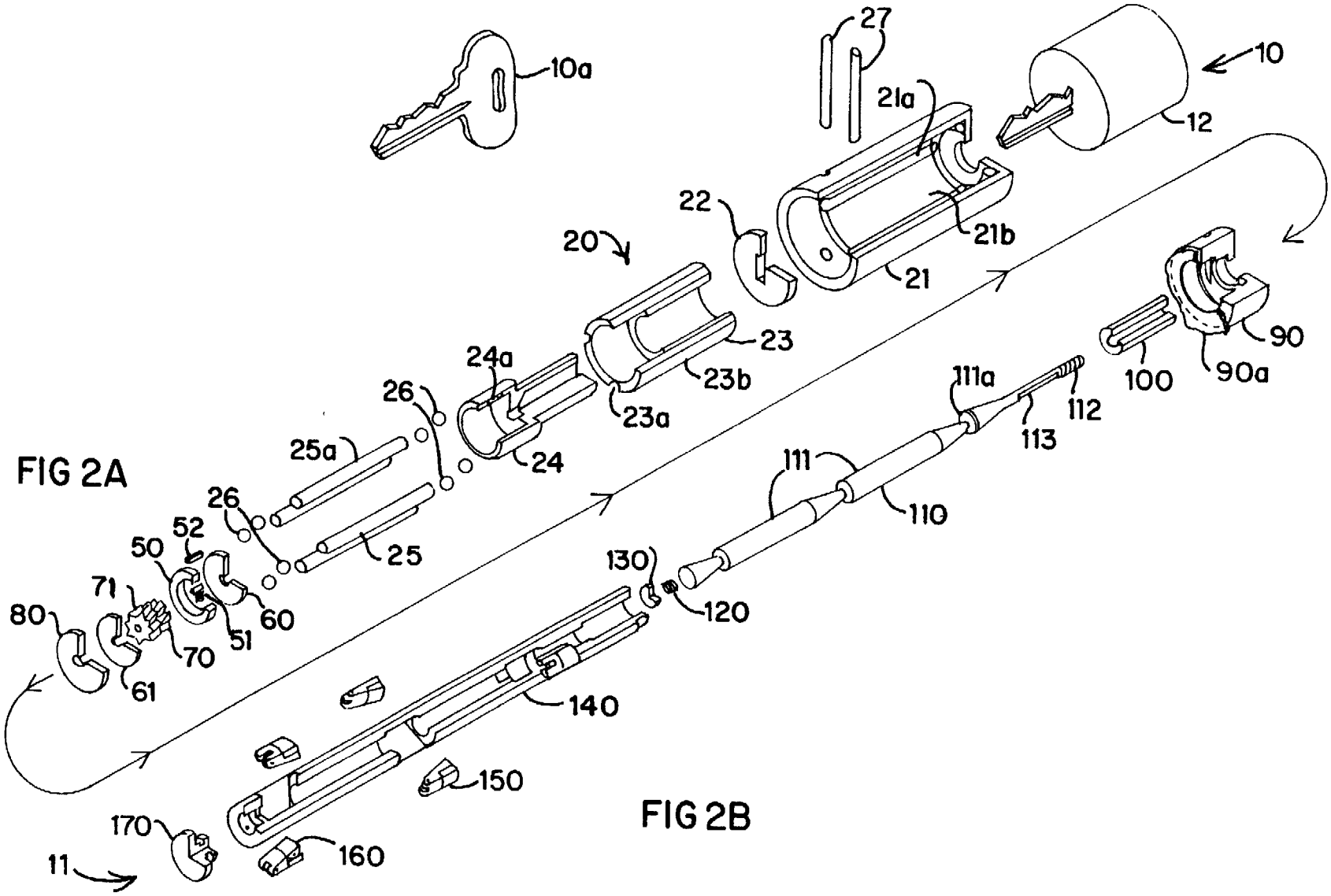
FIGS. 2A and 2B in combination present an exploded sectional view along the longitudinal axis of the locking device in accordance with the present invention.

In FIGS. 2A and 2B, the locking device 30 of the present invention is detailed from a proximal end 11 (near the firearm trigger) to a distal end 12 (near the end of the barrel 41). A control means in the form of a key 10, including a standard configured key 10*a*, renders the invention enabled and disabled via a lock 20. The type shown is a double-sided pin tumbler lock 20, however any suitable type may be used. The lock 20 includes a tumbler 23 and one or more pins 25, preferably made of steel or other suitable noncorrosive metal, or a rigid plastic. The pins 25 occupy parallel axial holes 21*a*, 23*a* drilled in the interface between an exterior surface 23*b* of the tumbler 23 and an interior surface 21*b* of a lock housing 21. Pins 25 anchor the tumbler 23 within the lock housing 21 so as to prevent rotational movement between tumbler 23 and lock housing 21. Pins 25 are freely rotatable in both clockwise and counter-clockwise directions. The number of pins 25 and related axial holes 21*a*, 23*a* employed may vary, as determined by the circumference of the lock housing 21 and by a protection requirement. The requirement is that of 360° protection of internal components housed within the lock housing 21 where additional vertically-oriented pins 27 provide added barrier against tampering. The embodiment shown in FIGS. 2A and 2B includes four pins 25, but there may be more than four. At the distal terminus 25*b* of each pin 25 is a ball beating 26 which facilitates rotational movement between these elements. As well, bearings 26 serve to protect the internal components of the locking device 30. Additional bearings (not shown) may be placed between associating and adjoining components to further assist rotational movement and provide added barriers against tampering.

Further in FIGS. 2A and 2B, a lock cam 24 is provided which rotates upon rotation of keys 10 and 10a during locking and unlocking procedures. Key 10*a* may be of a standard type (as shown), designed to be removed to allow the locking device 30 to be maintained in a locked or unlocked position without the insertion of a key. Alternatively, key 10 may be a safety type (as shown), designed to be kept in place within the lock housing 21 so that a user of the invention may maintain the locking device 30 in a locked position, while also being able to quickly unlock the device 30 without re-insertion of the key.

In a locking mode of operation, the locking device 30 is locked by the insertion of a key through slotted disk 22 and into lock cam 24 which freely rotates during key rotation. Initially, cylinder 140 is inserted through the muzzle of the firearm 40. Cylinder 140 is designed to be of a length sufficient to extend from the given firearm's muzzle 42 through the bore 43 of barrel 41 and into the chamber (not shown) aligned with the barrel 41. Dimensions may be altered to suit each given type of firearm without departing from the scope of the invention. Upon clockwise rotation of lock cam 24, annulus 50 travels a limited distance along the axial direction away from keys 10 and 10*a*. Spring-loaded wedges 51, which are placed on the inner surface of the annulus 50, force the annulus 50 to travel along bi-directional slip gear 70 during lock cam 24 rotation. The annulus 50 is rotationally fixed within lock cam 24 and moves axially along a key 52 within a keyway 24*a* on the inner surface of lock cam 24. Gear 70 may be machined from a single piece or consist of separate partsfastened together. Axial movement of wedges 51 and annulus 50 is restrained by a distal disk 60 and a proximal disk 61. These disks 60, 61 freely rotate.

The aforementioned components 22, 23, 24, 25, 26, 50, 51, 52, 60, 61, 70, and 80 are held within the lock housing 21 by lock foundation 90. The lock foundation 90 is permanently secured in place in the open end of the lock housing 21 via fastening pins 27 that extend, transverse to the axial direction, through holes within the lock housing 21 and lock foundation 90. The lock housing 21 and the lock foundation 90 am preferably manufactured to accept and to shelter the muzzle 42 and the region of the firearm 40 in the vicinity of the muzzle 42. A cushion 90*a* is placed upon the exposed area of lock foundation 90. The cushion 90*a* is replaceable and covers the union of lock foundation 90 and muzzle 42 when locking device 30 is in use to protect the finish of the firearm 40 and prevent any slippage at the union. Although one particular muzzle design is shown, it is to be understood that various muzzle designs may utilize the instant invention. Accordingly, it is within the scope of the invention that the particular shape of lock housing 21 and lock foundation 90 may be altered as needed to conform to any given muzzle design without straying from the instant invention's feature of sheltering the muzzle 42. Mounted on the proximal end 11 of the cylinder 140 is a chamber plug 170 which is freely rotatable about the proximal end 11 and serves to fully occupy the remainder of the firearm's chamber (not shown).

Gear 70 is rotatable in both clockwise and counter-clockwise directions. Through the center of gear 70 is a threaded axial hole 71. The threaded axial hole 71 is in mating relation to a threaded distal region 112 of shaft 110. During locking mode, annulus 50 is forced by spring-loaded wedge 51 to abut against proximal disk 61. Gear 70 rotates clockwise and pulls the threaded distal region 112 of shaft 110 through the threaded axial hole 71 of the gear 70. Bushing 100 maintains shaft 110 alignment and assists the free movement of shaft 110 and also serves as a barrier against tampering. Thus, the clockwise rotation of key 10 or key 10*a* causes shaft 110 to retract within the cylinder 140 towards lock housing 21.

Upon linear movement of shaft 110 towards lock housing 21, pivoting cams 150, 160 flare outward from cylinder 140. Cams 150, 160 are preferably of a triangular shape. Shaft 110 includes conical sections 111 over which cams 150, 160 slide. The conical sections 111 house and displace the cams 150, 160, which pivot within their fixed positions on cylinder 140. Cams 150, 160 are secured in place by removable, replaceable pins 166, or by hinges (not shown). Cams 150, 160 wedge themselves against the inner surface of the firearm chamber and barrel 41 until no further movement of shaft 110 is possible. At this point, spring loaded-wedge 51 on annulus 50 slips on gear 70. This slippage is audible to the user of the locking device 30 in the form of a clicking noise. The clicking indicates to the user that the locking procedure is complete. This slip-gear arrangement protects both the firearm 40 and the device 30 from damage during activation or de-activation of the device as it eliminates excessive torque from damaging the internal components of the device 30 as well as the interior surfaces of the firearm 40.

Under these conditions, the locking device 30 remains in place in a locked position upon removal of key 10 or key 10*a*. In an unlocking mode of operation, the locking device 30 is unlocked by the re-insertion of key 10 or 10*a* through slotted disk 22 and application of a counter-clockwise rotation. Upon counter-clockwise rotation of lock cam 24, annulus 50 travels a limited distance along the axial direction toward key 10 or 10*a* along gear 70. During unlocking mode, annulus 50 is forced by spring-loaded wedge 51 to abut against distal disk 60. Gear 70 rotates counter-clockwise and pushes the threaded distal region 112 of shaft 110 through the threaded axial hole 71 of the gear 70. Thus, the counter-clockwise rotation of key 10 or 10*a* causes shaft 110 to expand into cylinder 140 away from lock housing 21.

Upon linear movement of shaft 110 away from lock housing 21, pivoting cams 150, 160 retract inward into cylinder 140 from the force springs 161, and, spring 163 in the case of cam 160. Shaft 110 includes conical sections over which cams 150, 160 slide and reside. The conical shaped shaft sections displace the cams 150, 160, which pivot within their fixed positions on cylinder 140. Cams 150, 160 wedge themselves against a perpendicular plane 111*a* that is distal to the conical region 111 of the shaft 110 until no further movement of shaft 110 is possible. At this point, spring-loaded wedge 51 on annulus 50 slips on gear 70. As during locking, this slippage is audible to the user of the locking device 30 in the form of a clicking noise. Here, the clicking indicates to the user that the unlocking procedure is complete. Accordingly, the locking device 30 is free to be pulled out of the firearm chamber and barrel 41 by the user. Again, this arrangement protects against damage to the device 30 and the firearm 40 during operation.

Figure 3:
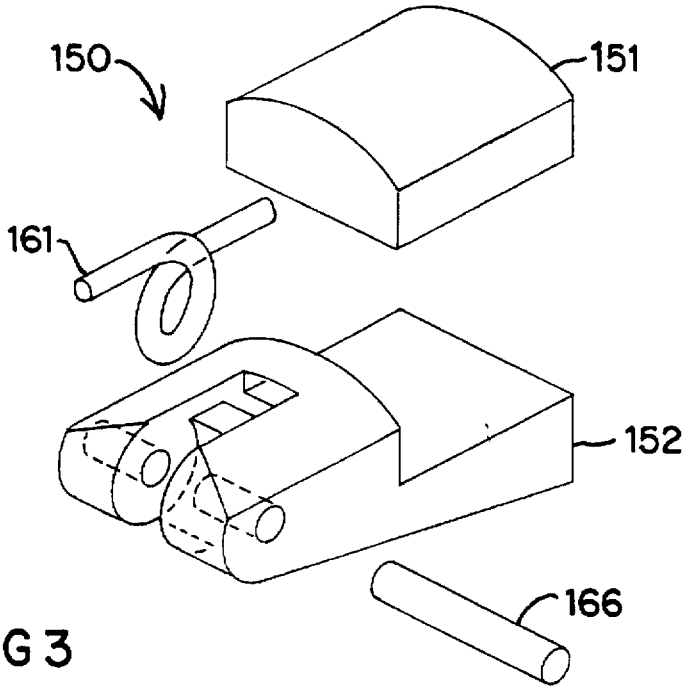
FIG. 3 is an exploded view of one embodiment of a pivoting cam in accordance with the present invention.
Figure 4:
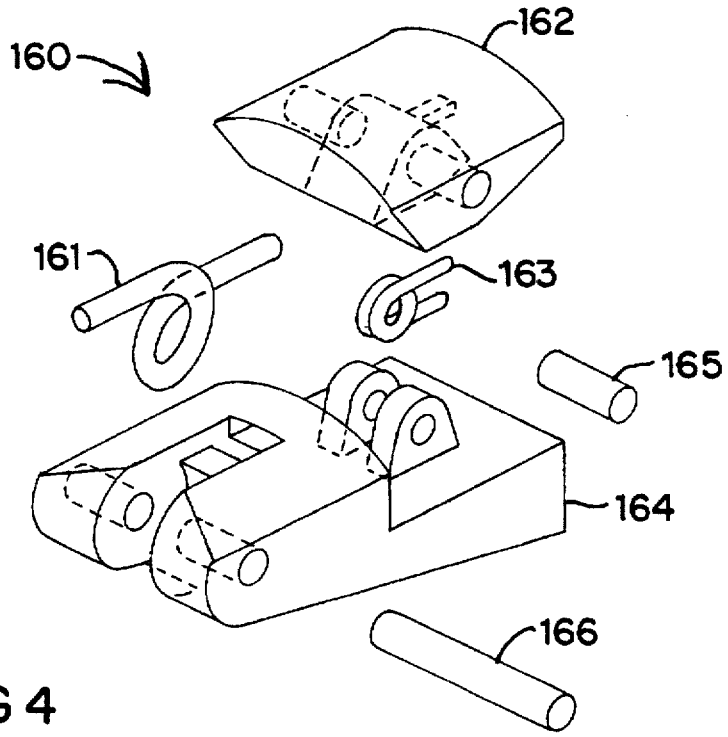
FIG. 4 is an exploded view of another embodiment of a pivoting cam in accordance with the present invention.

Further, FIGS. 3 and 4 show details of the cams 150, 160. Cams 150, 160 include two pieces. One piece is a contact pad which abuts the inner surface of the chamber (not shown) or the inner surface of the barrel 43. The contact pads are designed to be replaceable. The other piece is an intermediate piece between a pivot point on the cylinder 140 and the contact pad. Specifically seen in FIG. 3, cam 150 includes a contact pad 151 that is fixed upon its respective intermediate piece 152. In FIG. 4, cam 160 is shown to be articulated in construction. A contact pad 162 of cam 160 is pivotally mounted, including spring 163, by a small pin 165 upon its respective intermediate piece 164 which itself is pivotally mounted and pinned to the cylinder 140. Alternatively, a hinge (not shown) may be employed as a pivoting means. In contrast to cam 150, the contact pad 162 of cam 160 conforms flatly to the inner barrel surface 43 or inner chamber surface (not shown). The surface of this contact pad 162 may be smooth, textured, or structured. Spring 161 in both cams 150 and 160 assure full cam retraction into cylinder 140 facilitating locking-device removal.

An additional element in accordance with this invention is a pyric disk 80. The pyric disk 80 is freely rotatable and is located between lock foundation 90 and proximal disk 61. The location of pyric disk 80 is chosen to be near the gear 70, most suitably the section including the threaded distal region 112 of shaft 110. The pyric disk 80 is manufactured of a solder-like material that will melt when exposed to extreme heat. The solder-like material should be a metal that has a melting point at least as high as the temperature commonly attained by blow-torches. The effect is to cause shaft 110 and other internal components to be seized in place. A small channel 113 placed on the surface of shaft 110 in its threaded distal region 112 enables molten material of melted pyric disk 80 to migrate throughout the invention. This design, which allows molten material to migrate into the firearm, may be utilized to further dissuade unauthorized users from tampering with a firearm utilizing such an alternative design of the instant invention. It should be clear that such an alternative design is well within the scope of the present invention. Thus, pyric disk 80 is designed as a mechanism to protect against tampering via devices such as an acetylene torch.

With further reference to FIGS. 2A and 2B, a compression spring 120 is shown at the proximal region of shaft 110. Compression spring 120 places a constant axial force on the shaft 110 in the direction towards the distal end 12. This force is countered by the presence of the lock mechanism 20. In the event of tampering which severs the lock mechanism 20 from the remainder of the device 30, spring 120 will maintain cams 150, 160 in a wedged position.

FIG. 5 presents an illustrated emphasis of those components of the device 30 that are designed to provide continuous internal and external protection to the device 30 while it is activated. Specifically, disks 22, 60, 61, 80, and 130, bearings 26, pins 25 and 27, bushing 100, compression spring 120, and plug 170 are arranged to prevent damage to the slip gear 70 and to cams 150 and 160. While the interaction of these components has been described with reference to FIGS. 2A and 2B, it is important to note that the components shown in FIG. 5 permit the present invention to safely protect the firearm 40 from tampering along its entire length. There is no apparent weak point in the design of the device 30 because the components interact to protect the device 30 internally and externally from damage and tampering, in addition to protecting the firearm 40 from tampering.

Accordingly, this invention prevents use of a firearm upon locking and allows firearm operation after unlocking while also discouraging tampering with the invention. While specific reference has been made to particular embodiments of the invention, it is to be understood that those skilled in the field of this invention will contemplate modifications and equivalents deemed within the scope of the following appended claims.

I claim:

1. A locking device for controlling access to a length of a tubular element having an inner surface, said locking device comprising:

a shaft having one or more conical sections, one or more sets of cams engageable with said one or more conical sections of said shaft, wherein at least one cam of each of said one or more sets of cams has a contact pad pivotably mounted thereon and substantially conforming with a shape of said inner surface of said tubular element, a lock mechanism, and a control means for use within said lock mechanism to control movement of said shaft.

2. The locking device as claimed in claim 1, wherein said lock mechanism is a double-sided pin tumbler lock.

3. The locking device as claimed in claim 2, wherein said lock mechanism includes a plurality of pins.

4. The locking device as claimed in claim 1, wherein said control means is a safety key which enables and disables said locking device and is maintained within said lock mechanism during operation and use of said locking device.

5. The locking device as claimed in claim 1, wherein said control means is a removable key which enables and disables said locking device.

6. The locking device as claimed in claim 1, wherein said contact pads are replaceable and are made of a material of a hardness not more than a hardness of said inner surface of said tubular element.

7. The locking device as claimed in claim 6, further comprising a bi-directional slip gear couplable to said shaft, wherein said bi-directional slip gear is design to protect internal components and associated surfaces of said device within said tubular element when said device is activated or de-activated.

8. The locking device as claimed in claim 1 further comprising:

a pyric disk located within said lock mechanism, wherein said pyric disk is made of a material which has a melting point lower than substantially all other parts of said locking device.

9. The locking device as claimed in claim 1 further comprising:

a compression spring couplable to said lock mechanism.

10. The locking device as claimed in claim 1 further comprising:

a substantially cylindrical means for housing said cams, wherein said cylindrical means is superimposed upon said shaft, and said cams, upon engagement by said shaft, are displaced from a fixed position within said cylindrical means.

11. The locking device as claimed in claim 1 further comprising:

a plurality of disks spaced axially along said shaft and couplable to said locking mechanism, a compression spring couplable to said shaft, a plurality of axially-oriented, freely-rotatable pins couplable to said compression spring, a plurality of bearings within said locking mechanism, and a bushing couplable to said locking mechanism, wherein said disks, said compression spring, said pins, said bearings, and said bushing are strategically located to provide a physical barrier against tampering.

12. The locking device as claimed in claim 1, wherein said lock mechanism includes a lock housing and a lock foundation arranged together to protectively house one of either end of said tubular element.

13. The locking device as claimed in claim 12, further comprising a cushion to protect said one of either end of said tubular element.

14. A locking device for controlling access to a length of a tubular element having an inner surface, said locking device comprising:

a shaft having one or more conical sections, one or more sets of cams arranged in sets of at least two diametrically-opposed cams and engageable with said one or more conical sections of said shaft, each of said cams including a contact pad, wherein at least one of said contact pads of each of said one or more sets of cams has a contact surface substantially conforming with a shape of said inner surface of said tubular element, a lock mechanism, a control means for use within said lock mechanism to control shaft movement, and pyric disk located within said lock mechanism, wherein said pyric disk is made of a material which has a melting point lower than substantially all other parts of said locking device.

15. The locking device as claimed in claim 14, further comprising:

a substantially cylindrical means for housing said cams, wherein said cylindrical means is superimposed upon said shaft, said cams, upon engagement by said shaft, are displaced from a fixed position within said cylindrical means, and wherein each of said set of cams includes at least two cams, wherein cams within any one of said sets are placed in diametric opposition to one another.

16. The locking device as claimed in claim 15, wherein said contact pads are made of a material of a hardness not more than a hardness of said inner surface of said tubular element.

17. The locking device as claimed in claim 16, wherein said contact pads are fixedly mounted upon said cams.

18. The locking device as claimed in claim 16, wherein said contact pads are pivotably mounted upon said cams.

19. The locking device as claimed in claim 14, further comprising:

a lock housing coupled to a lock foundation, wherein said lock housing is designed to surround an exterior of said tubular element, and wherein an end of said lock foundation includes a cushion designed to abut an open end of said tubular element.

20. The locking device as claimed in claim 14, wherein said locking device occupies substantially all of an interior of said tubular element.

21. A locking device for controlling access to a length of a tubular element, said locking device comprising:

a shaft, a plurality of cams arranged in at least two sets and enagageable by said shaft, each of said cams including a contact pad made of a material of a hardness not more than a hardness of any tubular element surface upon which said contact pads rest during operation of said locking device, a substantially cylindrical means for housing said cams, wherein said cylindrical means is superimposed upon said shaft, said cams, upon engagement by said shaft, are displaced from a fixed position within said cylindrical means, wherein each of said set of cams includes at least two cams, wherein cams within anyone of said sets are placed in diametric opposition to one another, a lock mechanism including a double sided pin tumbler lock, a control means for use within said lock mechanism to control shaft movement, a pyric disk located within said lock mechanism, wherein said pyric disk is made of a material which has a melting point lower than substantially all other parts of said locking device, and a bi-directional slip gear couplable to said shaft, wherein said bi-directional slip gear is designed to protect internal components and associated surfaces of said device within said tubular element when said device is activated or deactivated.

22. The locking device as claimed in claim 21, wherein said bi-directional slip gear is couplable to a spring-loaded wedge within an annulus such that upon activation or de-activation of said device, contact between said wedge and said slip gear that causes a slippage of said wedge over said slip gear creates an audible noise designed to indicate that said locking device is fully engaged or fully disengaged.

23. The locking device as claimed in claim 21, wherein said control means is a safety-key which enables and disables said device and is maintained within said lock mechanism during operation and use of said locking device.

24. The locking device as claimed in claim 21, wherein said control means is a removable-key which enables and disables said locking device.

25. The locking device as claimed in claim 21, further comprising a chamber plug couplable to an end of said tubular element.

26. The locking device as claimed in claim 25, wherein said contact pads and said chamber plug are fabricated in shapes and of materials designed to be replaceable.

27. The locking device as claimed in claim 21, wherein said cams are designed to be fully containable within said cylindrical means such that said device may be inserted into or removed from said tubular element without said cams causing damage to an interior of said tubular element.

28. The locking device as claimed in claim 21, wherein said contact pads of said cams are designed to maximize surface-to-surface contact between said cams and an interior surface of said tubular element.

* * * * *